US010450941B2

(12) United States Patent
Cunningham et al.

(10) Patent No.: US 10,450,941 B2
(45) Date of Patent: Oct. 22, 2019

(54) ENGINE COOLING SYSTEM AND METHOD

(71) Applicant: Ford Global Technologies, LLC, Dearborn, MI (US)

(72) Inventors: Ralph Cunningham, Milan, MI (US); Joseph Ulrey, Dearborn, MI (US); Ross Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 94 days.

(21) Appl. No.: 15/885,346

(22) Filed: Jan. 31, 2018

(65) Prior Publication Data

US 2019/0234291 A1 Aug. 1, 2019

(51) Int. Cl.

| | |
|---|---|
| ***F01P 7/00*** | (2006.01) |
| ***F01P 7/16*** | (2006.01) |
| ***F01P 3/02*** | (2006.01) |
| ***F01P 5/12*** | (2006.01) |
| ***F01P 1/06*** | (2006.01) |
| ***F01P 7/12*** | (2006.01) |
| ***F01P 7/04*** | (2006.01) |
| *F02D 35/02* | (2006.01) |
| *F01P 5/10* | (2006.01) |
| *F01P 5/04* | (2006.01) |

(52) U.S. Cl.

CPC ..... *F01P 7/164* (2013.01); *F01P 1/06* (2013.01); *F01P 3/02* (2013.01); *F01P 5/12* (2013.01); *F01P 7/04* (2013.01); *F01P 7/12* (2013.01); *F01P 5/04* (2013.01); *F01P 2003/024* (2013.01); *F01P 2005/105* (2013.01); *F01P 2023/08* (2013.01); *F01P 2037/00* (2013.01); *F02D 35/027* (2013.01)

(58) Field of Classification Search

CPC ..... F01P 7/164; F01P 1/06; F01P 3/02; F01P 5/12; F01P 7/04; F01P 7/12; F01P 5/04; F01P 2003/024; F01P 2005/125

See application file for complete search history.

(56) References Cited

U.S. PATENT DOCUMENTS

| | | | | | |
|---|---|---|---|---|---|
| 1,985,240 | A * | 12/1934 | Brubaker | F01P 3/02 | 123/41.29 |
| 4,325,219 | A * | 4/1982 | Stang | F01P 7/165 | 60/599 |
| 4,621,594 | A * | 11/1986 | Kubis | F01P 3/207 | 123/41.09 |
| 6,082,626 | A * | 7/2000 | Morikawa | B60H 1/02 | 237/12.3 B |
| 6,247,429 | B1 * | 6/2001 | Hara | F01P 5/10 | 123/41.1 |

(Continued)

*Primary Examiner* — Thomas N Moulis

(74) *Attorney, Agent, or Firm* — Geoffrey Brumbaugh; McCoy Russell LLP

(57) ABSTRACT

Methods and systems are provided for expediting engine cooling while reducing the overall energy consumption of the engine cooling system's components. A first circulation pump is used to pump coolant through an engine block as a function of engine output while a second radiator pump is selectively operated when a thermostat valve is open to pump coolant through a radiator and the engine block to effect the engine coolant temperature. Operation of the second pump is coordinated with the operation of a radiator cooling fan and grille shutters to improve radiator performance.

20 Claims, 4 Drawing Sheets

(56) References Cited

U.S. PATENT DOCUMENTS 7,392,769 B2 * 7/2008 Heldberg ..... F01P 7/165 123/41.1
8,196,553 B2 6/2012 Kline et al.
2002/0005178 A1 * 1/2002 Iwatani ..... F01M 5/021 123/41.14
2005/0244280 A1 11/2005 Malone et al.
2006/0000428 A1 * 1/2006 Yamashita ..... F01P 7/165 123/41.14
2006/0096553 A1 * 5/2006 Takahashi ..... F01P 3/02 123/41.1
2006/0157002 A1 * 7/2006 Pfeffinger ..... F01P 7/162 123/41.29
2006/0162676 A1 * 7/2006 Pegg ..... F01P 7/164 123/41.1
2006/0231640 A1 * 10/2006 Hashimura ..... B60H 1/00492 237/34
2010/0139582 A1 * 6/2010 Bilezikjian ..... F01P 3/02 123/41.02
2011/0120146 A1 * 5/2011 Ota ..... B60H 1/00885 62/3.3
2011/0214627 A1 * 9/2011 Nishikawa ..... F01P 7/04 123/41.02
2012/0118248 A1 * 5/2012 Mehring ..... F01P 3/02 123/41.08
2012/0160447 A1 * 6/2012 Kinomura ..... B60H 1/025 165/51
2014/0326443 A1 * 11/2014 Kardos ..... F01P 7/165 165/287
2015/0144078 A1 * 5/2015 Hutchins ..... F01P 7/165 123/41.1
2015/0275742 A1 * 10/2015 Chekaiban ..... F01P 3/20 123/41.08
2016/0053666 A1 * 2/2016 Bruemmer ..... F01P 3/22 123/41.1
2016/0153343 A1 * 6/2016 Kakehashi ..... B60H 1/00885 123/41.31
2016/0201549 A1 * 7/2016 Kim ..... F01P 7/165 123/41.1
2016/0369685 A1 * 12/2016 Cho ..... F01P 7/164
2017/0284279 A1 * 10/2017 Turner ..... F01P 3/20
2017/0306831 A1 * 10/2017 Craft ..... F01P 3/02
2018/0313252 A1 * 11/2018 Aoyama ..... F01P 7/165
2019/0178156 A1 * 6/2019 Wi ..... F02B 67/06

* cited by examiner

ENGINE COOLING SYSTEM AND METHOD

FIELD

The present description relates generally to methods and systems for controlling an engine temperature via coordinated operation of a plurality of coolant pumps, a radiator fan, and grill shutters.

BACKGROUND/SUMMARY

Vehicles may include cooling systems configured to reduce overheating of an engine by transferring the heat to ambient air. Therein, coolant is circulated through the engine block to remove heat from the hot engine, and the heated coolant is then circulated through a radiator near the front of the vehicle. Heated coolant may also be circulated through a heat exchanger to heat a passenger compartment. The cooling system may include various components such as various valves and one or more thermostats.

One example of an engine coolant system is shown by Stang et al. in U.S. Pat. No. 4,325,219. Therein, the coolant system includes an engine loop and an aftercooler loop, coolant circulated through both loops via a single engine-driven pump. The engine loop includes the pump, the engine block, a first radiator, and a radiator bypass branch. The aftercooler loop includes the pump, the aftercooler, a second radiator, and a radiator bypass branch. Each loop further includes a temperature responsive flow control thermostat for regulating coolant flow through the associated radiator and/or bypass branch. The thermostat responds to the temperature of the coolant leaving the aftercooler. In still other examples, grille shutters coupled to a front end of the vehicle may be opened to expedite engine cooling.

However, the inventors herein have recognized potential issues with such systems. As one example, the system may have an elevated power consumption, which renders the engine fuel inefficient. For example, the inventors have recognized that the intermittent turning on and off of the radiator fan may be energy intense. Additional energy losses may occur when the pump is running while grille shutters are opened due to the increase in drag experienced due to grille shutter operation. Likewise, more energy may be consumed when the pump is operated while running the radiator fan(s). Even in engine systems where the pump speed can be independently controlled via an electric motor, the power usage may not be efficient.

Inefficiencies may originate from several causes. As a first example, inefficiencies may be caused from pumping against a closed or partially closed thermostat since this impedes the flow that the controller is trying to establish. As another example, pumping a radiator to provide a greater flow rate than needed to achieve a target engine outlet (or cylinder head) temperature wastes pumping power. As yet another example, operating the radiator fan at a higher speed than required to achieve a target radiator temperature drop wastes fan power. Cycling the radiator fan or radiator pump is also more power consumptive because the fluid power increases with the cube of velocity, faster than the heat transfer increases with velocity. Inefficiencies are also caused by aerodynamics being affected by the grille shutter being open.

The inventors herein have recognized that both radiator pumping and radiator fan operation is required to reject significant heat power. Zero coolant flow with the fan running results in no cooling. Likewise, zero air flow with the coolant pumping also provides no cooling. In other words, both are needed and at the same time. The radiator coolant pump accounts for nearly all the coolant flow since the natural convection is minimal in the engine. The radiator air cooling can be significant at cold ambient and/or at high vehicle speed. By allocating power to the radiator coolant pump versus the radiator fan so as to maintain a target minimum radiator temperature drop (engine outlet temperature minus radiator outlet temperature) via the radiator fan and grille shutters allows engine cooling to be provided while minimizing the power losses. Then, the radiator coolant pump can be controlled to achieve the target engine coolant outlet temperature.

In one example, engine cooling may be provided more efficiently by an engine coolant system comprising: a first pump coupled between a thermostat and a cylinder head; a second pump coupled between the thermostat and a radiator fan; grille shutters; a first temperature sensor for sensing coolant temperature at a radiator outlet; and a second temperature sensor for sensing the coolant temperature at a radiator inlet. The system may further comprise a controller including computer-readable instructions stored on non-transitory memory for adjusting an output of the first pump based on engine power, the first pump operated independent of a state of the thermostat; and selectively operating the second pump responsive to the thermostat being open. In this way, engine cooling can be provided in a more power efficient manner.

As one example, an engine cooling system may be configured to include a first electrically powered circulation pump, a second electrically powered radiator pump, a radiator fan, and grille shutters. An additional pump may be optionally included for circulating heat through a cabin heating loop. The first pump may be separated from the second pump in a coolant loop via a thermostat valve. The fully-open temperature of the thermostat valve may be set to be below the target engine coolant temperature (ECT). In addition, the system may include a plurality of sensors such as an engine coolant temperature (ECT) sensor, a cylinder head temperature (CHT) sensor, a radiator inlet temperature (RIT) sensor, and a radiator outlet temperature (ROT) sensor. By including two pumps, the jobs of circulating coolant and radiator pumping are distributed between the pumps. In particular, the circulation pump may be selectively coupled to the engine block and may be operated to maintain substantially isothermal conditions at the engine. This reduces the occurrence of hot spots near the cylinder heads. The circulation pump is controlled, open loop, as a function of a difference between ECT and CHT. Alternatively, the circulation pump output may be adjusted as a function of engine power. This allows the circulation pump to be operated to reduce the ECT to CHT difference to (or below) a threshold value. The radiation pump is coupled to the radiator, and is selectively coupled to the engine block when the thermostat valve is open. The radiation pump is operated to achieve a target engine temperature (e.g., a target CHT). In particular, the radiator pump may be selectively operated only when the thermostat valve is fully open, thereby reducing energy being wasted in pumping against a fully or partially restricted valve. Since the target ECT is selected to be above the thermostat fully open temperature setting, the thermostat effectively acts as a device that blocks flow for cold and warm coolant, enhancing cylinder head warm-up. When the thermostat valve is open, the radiator pump is the primary effector for controlling engine temperature. The radiator fan and grille shutters are operated to improve the efficiency of the radiator, such as by maintaining a target temperature drop across the radiator. For example, the radiator fan speed is controlled as a function of the difference between RIT and ROT.

In this way, engine cooling is provided while reducing the overall power consumption of the engine cooling system. The technical effect of separating engine cooling functions between a circulation pump operated distinct from a radiator pump is that heat transfer at the cylinder head can be optimized independent of optimizing heat loss at the radiator. By using the circulation pump to maintain a threshold temperature difference between coolant temperature and engine temperature, cylinder head hot spot occurrence is reduced. By using the radiator pump to regulate the coolant temperature to a target setting, radiator operation may be better coordinated with engine heating/cooling operations. By operating the radiator pump only when the thermostat valve is open, cycling of the radiator pump is reduced, decreasing associated power losses. Likewise, by controlling the grille shutters and radiator fan to provide a target temperature difference across the radiator, cycling of the fan and the grille shutters is reduced, decreasing associated power losses. In particular, the power losses associated with cycling the radiator fan on and off is reduced by operating the radiator fan constantly at a lower speed. By reducing power losses across the engine cooling system, the efficiency of the engine cooling system is improved, improving overall engine fuel economy. Overall, engine cooling hardware can be configured to allow for a minimum energy to be expended on cooling an engine while implementing a control approach that minimizes the power spent on cooling the engine.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
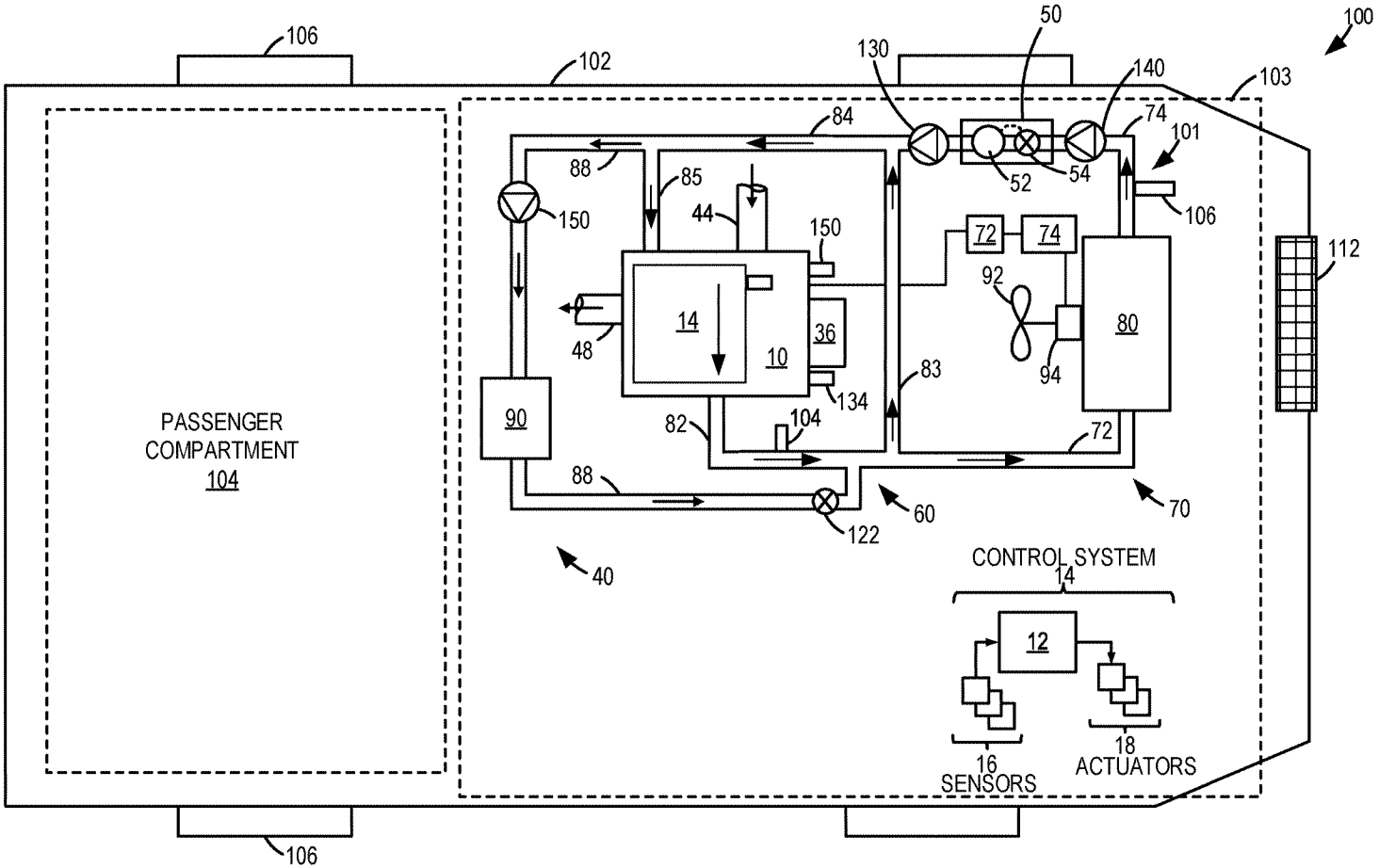
FIG. 1 shows a schematic diagram of a vehicle system including a cooling system according to an embodiment of the present disclosure.
Figure 2:
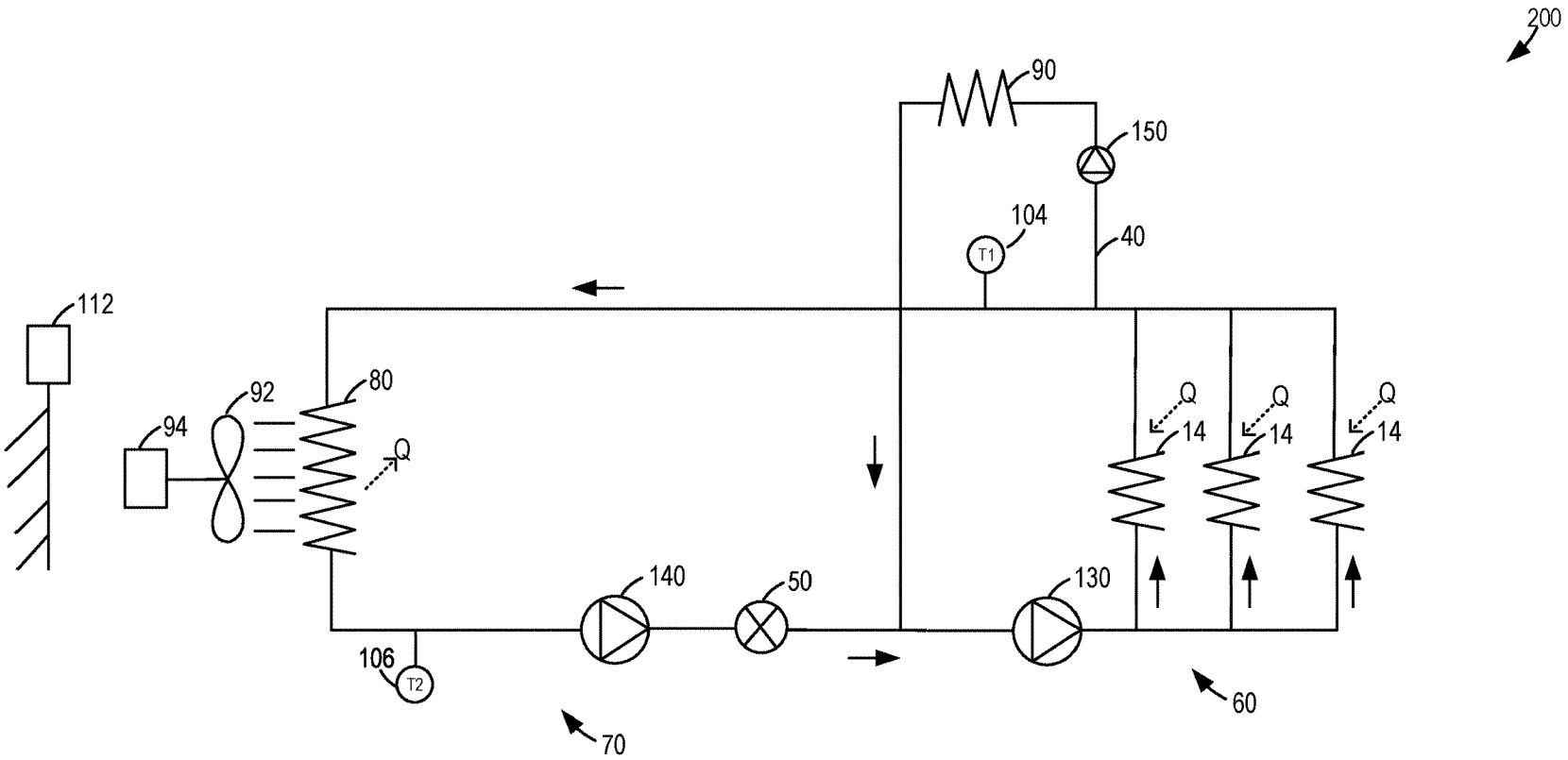
FIG. 2 shows a circuit depiction of the cooling system of FIG. 1.

Methods and systems are provided for operating a cooling system for engine temperature control, such as the cooling system of FIGS. 1-2, coupled to an engine of a vehicle system. An engine controller may be configured to perform a control routine, such as the example routine of FIG. 3, to expedite engine temperature control by coordinating the operation of a circulation pump and a radiator pump with radiator fan and grille shutter operation. An example operation is shown with reference to FIG. 4.

FIG. 1 shows an example embodiment of a vehicle system 100 including a vehicle cooling system 101 in a motor vehicle 102. Vehicle 102 has drive wheels 106, a passenger compartment 104 (herein also referred to as a passenger cabin), and an under-hood compartment 103. Under-hood compartment 103 may house various under-hood components under the hood (not shown) of motor vehicle 102. For example, under-hood compartment 103 may house internal combustion engine 10. Internal combustion engine 10 has a combustion chamber which may receive intake air via intake passage 44 and may exhaust combustion gases via exhaust passage 48. Engine 10 as illustrated and described herein may be included in a vehicle such as a road automobile, among other types of vehicles. While the example applications of engine 10 will be described with reference to a vehicle, it should be appreciated that various types of engines and vehicle propulsion systems may be used, including passenger cars, trucks, etc.

Under-hood compartment 103 may further include cooling system 101 that circulates coolant through internal combustion engine 10 to absorb waste heat, and distributes the heated coolant to radiator 80 and/or heater core 90 via coolant lines (or loops) 60, 70, and 88, as elaborated below.

Coolant may be circulated through a first loop 60 (herein also referred to as a circulation loop) of the cooling system via operation of a first circulation pump 130. First loop 60 includes passages 82-85. Circulation pump 130 may be an electrically actuated pump driven by an electric motor drawing power from a system battery. Circulation pump 130 circulates coolant through passages 82, 83, 84, and 85 to flow coolant through engine 10, including through an engine block, and cylinder heads 14, to absorb engine heat. By operating circulation pump 130, hot spots at the cylinder heads 14 are removed. Reverse flow of coolant through passage 83 is prevented via check valve 132. Heated coolant is then directed into second loop 70, also known as the radiator loop, via operation of the circulation pump 130, so that the heat can be transferred out of the coolant to ambient air via radiator 80.

Circulation pump 130 is operated to maintain substantially isothermal conditions in first loop 60. To achieve this, circulation pump 130 is operated, open loop, as a function of engine power, which may be measured or inferred via a surrogate parameter such as fuel consumption. For example, as engine power increases, the output (e.g., flow, speed, etc.) of circulation pump 130 may be increased. It is understood that this would also be a function of engine coolant temperature or cylinder temperature. During warm-up the coolant is relatively cool and little or no circulation flow is required. If an additional temperature sensor were included to detect a temperature spread within the engine, the control system would control the circulation power to be the minimum required to limit that temperature difference. When the radiator pump is pumping, pumps 140 and pump 130 work in-series. An engine controller may power them proportionally. For example, the controller may allocate power to each of them as a function of the cooling provided by each of them. As elaborated herein, the flow produced by circulation pump 130 increases monotonically with cylinder waste heat production. In one example, circulation pump 130 is a centrifugal pump, and the pressure (and resulting flow) produced by the pump may be increased by increasing pump output via adjustments to the output of the associated electric motor.

Second loop 70 includes passages 72 and 74. Passage 72 of the second loop 70 couples passage 82 of the first loop 60 to an inlet of the radiator. Passage 74 of the second loop 70 is coupled to passage 84 of the first loop 60 at downstream of an outlet of the radiator, and downstream of a thermostat 50. Second loop 70 includes a second radiator pump 140 for directing coolant cooled by the radiator to the engine 10 and cylinder heads 14. The function of radiator pump 140 is to pump coolant through the radiator once the engine is not rejecting enough heat in other ways (such as via the radiator). By separating the job of circulation and radiator pumping into separate jobs performed by distinct pumps, engine efficiency benefits are achieved. Radiator pump 140 is selectively operated when thermostat valve 50 is open. Thus thermostat 50 blocks flow for warm coolant (coming out of engine 10) and cold coolant (going into engine 10 from downstream of the radiator). In one example, second pump 140 is also centrifugal pump, and the pressure (and resulting flow) produced by the pump may be increased by increasing pump output via adjustments to the output of the associated electric motor.

A temperature of coolant directed towards the radiator (radiator inlet temperature or RIT) may be estimated via a temperature sensor 104 coupled to passage 82. A temperature of coolant directed from the radiator to the engine (herein referred to as radiator outlet temperature or ROT) may be estimated via a temperature sensor 106 coupled to passage 74.

Path 83 is a low flow resistance path. Flow prefers this path. Conventionally, radiators are hot in at top and cold out at bottom. Conventionally, engines are cold in at bottom and hot out at top. It will be appreciated that the two pumps may be placed gravitationally low to reduce caviration.

One or more cooling fans may be included in cooling system 101 to provide airflow assistance and augment a cooling airflow through the under-hood components. For example, cooling fan 92, coupled to radiator 80, may be operated to provide cooling airflow assistance through radiator 80. Cooling fan 92 may draw a cooling airflow into under-hood compartment 103 through an opening in the front-end of vehicle 102, for example, through grille shutter system 112. Such a cooling air flow may then be utilized by radiator 80 and other under-hood components (e.g., fuel system components, batteries, etc.) to keep the engine cool. Further, the air flow may be used to reject heat from a vehicle air conditioning system. Further still, the airflow may be used to improve the performance of a turbocharged/supercharged engine that is equipped with intercoolers that reduce the temperature of the air that goes into the intake manifold/engine. In one example, grille shutter system 112 may be configured with a plurality of louvers (or fins, blades, or shutters) wherein a controller may adjust a position of the louvers to control an airflow through the grill shutter system.

Cooling fan 92 may be coupled to, and driven by, engine 10, via alternator 72 and system battery 74. Cooling fan 92 may also be mechanically coupled to engine 10 via an optional clutch (not shown). During engine operation, the engine generated torque may be transmitted to alternator 72 along a drive shaft (not shown). The generate torque may be used by alternator 72 to generate electrical power, which may be stored in an electrical energy storage device, such as system battery 74. Battery 74 may then be used to operate a cooling fan electric motor 94.

The temperature of the coolant may be regulated by thermostat 50. Thermostat 50 may include a temperature sensing element 52, and a thermostat valve 54. The thermostat valve 54 remains closed until a temperature of coolant coming out of the radiator reaches a threshold temperature. Specifically, thermostat valve 54, communicatively coupled to the temperature sensing element 52, is configured to open only when the coolant temperature in the second loop 70 is above the threshold temperature. In one example, thermostat valve 54 may be a mechanically actuated valve, such as a wax plug.

The threshold temperature (herein also referred to as the target opening temperature) for the thermostat may be set to be lower than the target coolant temperature desired in the cooling system. The threshold temperature may be variable and may be set based on engine operating conditions such as intake air temperature and engine power level. In one example, the threshold temperature for opening the thermostat is set to be 85° C. while the target coolant temperature is set to be 95° C. The target coolant temperature may be further adjusted based on feedback and feed-forward knock. For example, responsive to an indication of engine knock, as sensed via knock sensor 150 coupled to engine 10, the controller may lower the target coolant temperature. Likewise, responsive to a history of engine knock (such as a higher than threshold knock count), the controller may lower the target coolant temperature.

In response to the temperature sensing element 52 being exposed to coolant coming out of the radiator that is higher than the threshold temperature, thermostat valve 54 is opened, allowing coolant to flow out of the second loop 70 and into first loop 60. The temperature sensing element 52 being exposed to coolant coming out of the radiator that is higher than the threshold temperature indicates that the radiator 80, alone, is not able to provide sufficient heat transfer out of the coolant into the ambient air. Thus, by operating radiator pump 140 only when the radiator cooling is not sufficient, electrical power consumption is reduced while improving engine efficiency. By operating radiator pump 140 only when the thermostat valve 54 is open, pumping of heated coolant against a closed valve is reduced, reducing associated electrical power losses.

In conventional cooling systems, the thermostat may be only partially open when the radiator pump or the radiator fan is drawing power. In comparison, in the depicted system, the thermostat is fully open before either the radiator fan or the radiator pump draws power. A wax-powered thermostat may begin to open at 85° C. and be fully open at 95° C. while an electrically-actuated thermostat may be programmed to open at 95° C. and close at 90° C., thus providing hysteresis-preventing cycling.

When thermostat valve 54 is open, radiator pump 140 may be operated to improve the efficiency of radiator 80. Specifically, radiator pump 140 is operated, closed loop, as a function of the measured engine coolant temperature, which may be measured via ECT sensor 134 (or measured cylinder heat temperature, as measured via CHT sensor 136), so as to drive it towards the target coolant temperature. For example, as ECT (or CHT) exceeds the target coolant temperature, the output (e.g., flow, speed, etc.) of radiator pump 140 may be increased. Increased flow of coolant is then directed from the second loop 70 into the first loop 60, specifically, from the radiator outlet to the engine 10 and cylinder heads 14. In this way, when the thermostat valve 54 is open, the radiator pump 140 is the primary end-effector for reaching the target engine temperature.

At the same time, the operation of cooling fan 92 and grille shutter system 112 is optimized and coordinated with radiator pump 140 operation to improve heat loss across the radiator 80. For example, cooling fan 92 is operated as a function of the temperature drop across the radiator 80. In one example, the temperature drop across the radiator is measured via temperature sensors 104, 106. In alternate examples, the temperature drop may be inferred based on one or more or each of the engine power level, engine inefficiency, manifold air temperature, radiator fan speed, radiator grille shutter position, and coolant temperature (which may be ECT or CHT). Thus, as the temperature difference decreases, cooling fan speed is increased to raise the temperature difference to at least a threshold difference. By running the cooling fan only when the radiator pump 140 is pumping and while the engine temperature is nearing the target temperature, the electrical power consumption of the cooling fan is reduced. In addition, frequent cycling of the fan between on and off states is reduced. In particular, inventors have realized that the power consumption associated with operating the cooling fan for a longer duration at a lower power setting may be significantly lower than cycling the fan on (to a higher setting) and off.

Likewise, the operation of grille shutter system 112 may be adjusted as a function of the temperature drop across the radiator 80. For example, as the temperature difference decreases, the opening of the grille shutters may be increased to increase cooling flow through the under-hood compartment 103, while accounting for drag concerns. For example, the grille shutter opening may be increased to a degree where the fuel economy benefit of the cooling flow exceeds the fuel penalty associated with the additional drag.

As one example, the controller may compute the vehicle power associated with opening versus closing the grille shutters. The controller may further determine the power being supplied to the radiator. The controller would then select the cooling mode that costs the least power (that is, increases fuel flow the least amount). The added fuel consumption (per distance) to open the grille shutters increases with square of vehicle speed.

Coolant may also flow through a third heater core loop 40 which includes a heater core 90 and passage 88. Heater core 90 may be configured to transfer heat to passenger compartment 104. A third pump 150 may be coupled to third loop 40 for circulating coolant through the loop. Third pump 150 may be selectively operated responsive to a request for cabin heating. After passing through the heater core, coolant flows back to first loop 60 through valve 122. Specifically, heater core 90, which is configured as a water-to-air heat exchanger, may exchange heat with the circulating coolant and transfer the heat to the vehicle passenger compartment 104 based on operator heating demands. As such, heater core may also be coupled to a vehicle HVAC system (or heating, ventilation, and air conditioning system) that includes other components such as a heater fan, and an air conditioner (not shown). Based on a cabin heating/cooling request received from the operator, the HVAC system may warm cabin air using the heated coolant at the heater core to raise cabin temperatures and provide cabin heating.

In general, the heat priority may include cabin heating demands being met first, followed by combustion chamber heating demands being met, followed by powertrain fluid/lubricant heating demands being met. However, various conditions may alter this general priority. Ideally, no heating would be rejected by the radiator until all the above components are at full operating temperature. When cabin heating is requested, heater core pump 150 is powered. This will provide any available heat to the heater core.

One example pump engine heating and cooling operation is described now. During a cold start, none of the pumps run at all. Then, during the engine warm-up (such as about one minute into the warm-up), the engine coolant temperature heats to approximately 70° C. At this point the circulation pump 130 turns on to prevent local boiling in the water jacket in the cylinder head. As the engine outlet water heats to 85° C., the thermostat begins to open. At 95° C. the thermostat is fully open. Slightly above the 95° C., the grille shutters may also open. Also, slightly above 95° C., the radiator pump begins to pump. As the engine outlet water temperature gets close to the radiator outlet temperature, the target temperature drop out of the radiator is nit achieved. Responsive to this, the controller increases the radiator air flow rate via adjustments to the grille shutter opening (e.g., moving the grille shutters to a more open position) and/or radiator fan power (e.g., increasing fan speed). The radiator pump is controlled to achieve a target engine outlet temperature (with the flow rate increasing as temperature exceeds the target). The radiator air flow rate is controlled to achieve a target temperature drop across the radiator (with an increase in air flow rate provided that is just enough to achieve the target temperature drop across the radiator).

FIG. 1 further shows a control system 14. Control system 14 may be communicatively coupled to various components of engine 10 to carry out the control routines and actions described herein. For example, as shown in FIG. 1, control system 14 may include an electronic digital controller 12. Controller 12 may be a microcomputer, including a microprocessor unit, input/output ports, an electronic storage medium for executable programs and calibration values, random access memory, keep alive memory, and a data bus. As depicted, controller 12 may receive input from a plurality of sensors 16, which may include user inputs and/or sensors (such as gas pedal input, vehicle speed, engine speed, mass airflow through the engine, ambient temperature, intake air temperature, etc.), cooling system sensors (such as engine coolant temperature sensor, cylinder heat temperature sensor, radiator inlet and outlet temperature sensors, cooling fan speed sensor, passenger compartment temperature sensor, ambient humidity sensor, pump output sensor, etc.), and others. Further, controller 12 may communicate with various actuators 18, which may include engine actuators (such as fuel injectors, an electronically controlled intake air throttle plate, spark plugs, etc.), cooling system actuators (such as pumps 130, 140, 150, valves 54 and 122 of the cooling system), and others. In some examples, the storage medium may be programmed with computer readable data representing instructions executable by the processor for performing the methods described below as well as other variants that are anticipated but not specifically listed.

The controller 12 receives signals from the various sensors of FIG. 1 and employs the various actuators of FIG. 1 to adjust engine operation based on the received signals and instructions stored on a memory of the controller. For example, responsive to the sensed or inferred engine coolant temperature, the controller may adjust the output speed or flow of the first pump 130 as well as the output of the second pump 140. As one example, as a difference between the engine coolant temperature and a cylinder head temperature increases, the output of the first pump may be increased. As another example, while the thermostat valve is open, as a difference between the engine coolant temperature and a target coolant temperature increases, the output of the second pump may be increased. Increasing the output of the pump includes spinning the electric motor associated with the pump at an increasingly higher speed.

In some examples, vehicle 102 may be a hybrid vehicle with multiple sources of torque available to one or more of the vehicle wheels 106. In other examples, vehicle 102 is a conventional vehicle with only an engine, or an electric vehicle with only electric machine(s). For example, in addition to engine 10, vehicle 102 may be configured with an electric machine that may be a motor or a motor/generator. Therein, the crankshaft of engine 10 and the electric machine may be connected via a transmission to vehicle wheels 102 when one or more clutches are engaged. A first clutch may be provided between the engine crankshaft and the electric machine, while a second clutch may be provided between the electric machine and the transmission. Controller 12 may send a signal to an actuator of each clutch to engage or disengage the clutch, so as to connect or disconnect crankshaft from electric machine and the components connected thereto, and/or connect or disconnect electric machine from transmission and the components connected thereto in the vehicle driveline. The transmission may be a gearbox, a planetary gear system, or another type of transmission. The powertrain may be configured in various manners including as a parallel, a series, or a series-parallel hybrid vehicle.

Electric machine may receive electrical power from a traction battery to provide torque to the vehicle wheels. The electric machine may also be operated as a generator to provide electrical power to charge the system battery, such as battery 74, for example during a braking operation.

FIG. 1 shows an example configuration with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Turning to FIG. 2, a simplified circuit depiction 200 of the cooling system of FIG. 1 is shown. Components previously introduced in FIG. 1 are similarly numbered. FIG. 2 depicts the heat (Q) input into the engine coolant via the cylinder heads 14 via dashed arrows (pointing towards the cooling system). Likewise, heat (Q) lost from the engine coolant via the radiator 80 is depicted by dashed arrows (pointing away from the coolant system).

In this way, the components of FIGS. 1-2 enable an engine coolant system comprising: a first pump coupled between a thermostat and a cylinder head; a second pump coupled between the thermostat and a radiator fan; grille shutters; a first temperature sensor for sensing coolant temperature at a radiator outlet; and a second temperature sensor for sensing the coolant temperature at a radiator inlet. The system may further comprise a controller including computer-readable instructions stored on non-transitory memory for: adjusting an output of the first pump based on engine power, the first pump operated independent of a state of the thermostat; and selectively operating the second pump responsive to the thermostat being open. The system may further comprise an engine coolant temperature (ECT) sensor and a cylinder head temperature (CHT) sensor, and wherein adjusting the output of the first pump based on engine power includes adjusting the output of the first pump as a difference between sensed engine temperature and target engine temperature increases, the sensed engine temperature including sensed ECT or sensed CHT. The controller may include further instructions for adjusting the target engine temperature as a function of each of intake air temperature, engine power, and feedback knock from a knock sensor. In one example, the target engine temperature is lowered as the intake air temperature decreases, the engine power increases, or the feedback knock increases. Additionally, the output of the first pump may be increased monotonically as the difference between the sensed engine temperature and the target engine temperature increases. As an example, adjusting the output of the first pump includes adjusting one or more of pump speed, pump flow rate, and pump output pressure. As another example, adjusting the output of the first pump based on engine power includes increasing the output of the first pump until sensed engine temperature is at the target engine temperature. Selectively operating the second pump responsive to the thermostat being open may include when the thermostat is open, adjusting an output of the second pump as a function of a difference between sensed radiator inlet temperature (RIT) and sensed radiator outlet temperature (ROT). For example, the output of the second pump may be increased as the difference between sensed RIT and sensed ROT decreases. Further, an opening temperature of the thermostat may be set to be lower than the target coolant temperature. Further still, the controller may include further instructions for: while operating the second pump, adjusting a speed of the radiator fan and a degree of opening of the grill shutters to maintain a threshold difference between temperature at the radiator inlet and the radiator outlet.

Figure 3:
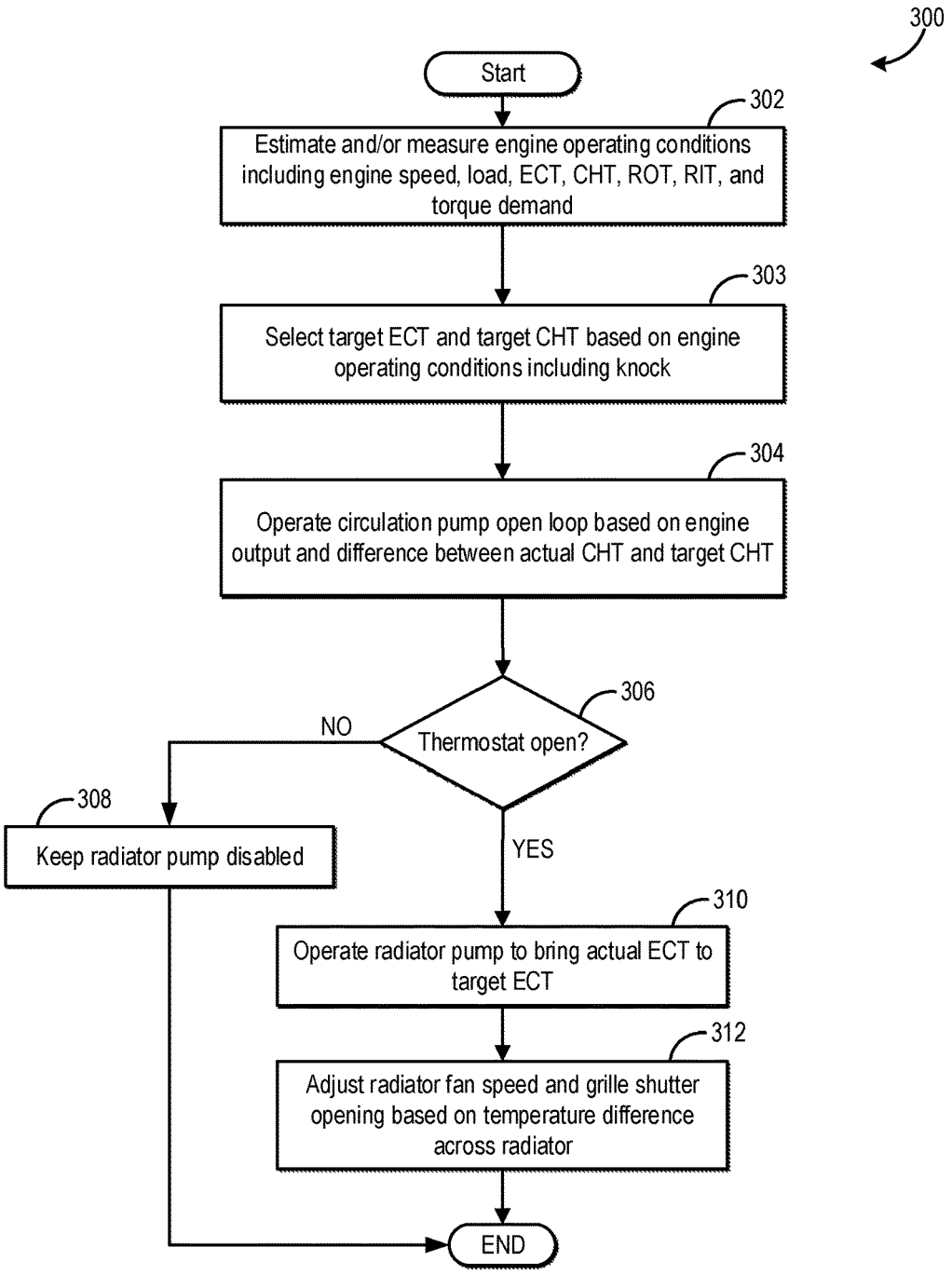
FIG. 3 shows a high level flow chart of an example method for operating the cooling system of FIGS. 1-2 to control engine temperature in a fuel efficient manner.

Turning now to FIG. 3, an example method 300 is shown for adjusting operation of the plurality of pumps of the cooling system of FIGS. 1-2 so as to provide engine heating/cooling more efficiently while reducing electrical power consumption. Instructions for carrying out method 300 may be executed by a controller based on instructions stored on a memory of the controller and in conjunction with signals received from sensors of the engine system, such as the sensors described above with reference to FIG. 1. The controller may employ actuators of the engine system to adjust engine operation, according to the methods described below.

At 302, engine operating conditions may be estimated and/or measured. These may include, for example, engine speed, engine coolant temperature (ECT), cylinder head temperature (CHT), radiator inlet temperature (RIT), radiator outlet temperature (ROT), catalyst temperature, ambient conditions (e.g., ambient temperature, pressure, humidity), cabin heating demands, torque demands, vehicle speed, etc.

At 303, the method includes selecting a target ECT and a target CHT based on engine operating conditions including knock. For example, the controller may use engine intake air temperature, engine speed and load, and engine knock (feedforward and feedback knock) as inputs for determining the target temperature. The controller may use a model, algorithm, or look-up table into which the above-mentioned inputs are provided and a target temperature is output. For example, the temperature may be lowered as the intake air temperature increases. Further, responsive to feedback knock, as indicated via a knock sensor, the controller may further adjust the target coolant temperature in real time. For example, responsive to feedback knock, the target temperature may be lowered. As another example, responsive to feedback knock, as indicated via a knock history (or higher than threshold knock count) of the engine, the target temperature may be lowered.

At 304, the method includes operating the circulation pump coupled to the engine in an open loop manner based on engine output. For example, the engine output may be inferred based on engine fuel consumption. Alternatively, the pump output may be adjusted as a function of the difference between sensed CHT and target CHT. As an example, as the difference increases, an output of the circulation pump may be increased. The output may include a pump speed, a pump flow rate, and/or a pump pressure. The controller may use the measured difference as an input to a look-up table, model, or algorithm which may generate the pump setting as an output. For example, the output of the circulation pump may increase monotonically as cylinder waste heat generation increases. By operating the circulation pump as a function of the engine power, cylinder hot spot occurrence may be reduced.

In particular, the circulation pump may be enabled when CHT is above a lower threshold temperature, when there is a chance of local boiling. In one example, the circulation pump is enabled during an engine cold-start after CHT is at or above 70° C. Then, its power level is monotonically increased with engine power. Disabling of the circulation pump may be delayed for some seconds after the engine is shut-down to prevent after-boiling if the engine was recently being operated at a high power level. Thus, the control inputs for the circulation pump include measured CHT, engine power, and time since engine shutdown. The output of the circulation pump is increased as the measured CHT exceeds the target CHT, and as the engine power increases. The output of the circulation pump is decreased as the time since engine shutdown increases.

At 306, it may be determined if the thermostat valve is open. The thermostat valve may be held closed as long as CHT is well below target CHT (such as when the difference is higher than a threshold). Once actual CHT is within a threshold (e.g., within 5 or 7° C. of target CHT), the thermostat valve is opened to allow natural convection between the engine and the radiator. As elaborated below, the thermostat valve is always opened if the radiator pump or radiator fan is on.

In one example, the thermostat valve is open if the coolant temperature sensed in the radiator loop is higher than the target coolant temperature, such as when the sensed ECT is higher than the target ECT. As described earlier, the target coolant temperature may be a variable temperature that is set based on engine operating conditions such as air temperature and engine power level. With very cold air, the engine can tolerate a slightly higher coolant temperature. With a very light power level, the engine can tolerate a slightly higher coolant temperature.

High coolant temperature promotes fuel economy until it contribute to spark knock or pre-ignition at high engine power, high engine air charge, or high engine combustion air temperature. Thus, the target temperature is also determined as a function of feedback knock.

If the thermostat is not open, such as when the sensed coolant temperature is lower than the target coolant temperature, at 308, the radiator pump may be kept disabled. By operating the circulation pump separate from the radiator pump, while the thermostat valve is closed, hot coolant is separated from cold coolant, enhancing cylinder head warm-up. By reducing heat lost to the radiator, engine coolant warm-up is expedited. The method then ends up with only the circulation pump being operated for engine temperature control in an open-loop manner. If the thermostat is open, such as when the sensed coolant temperature is higher than the target coolant temperature, at 310, the radiator pump may be enabled and operated to bring the ECT to the target coolant temperature. For example, the radiator pump may be operated closed-loop based on the sensed ECT. In one example, as the difference between the ECT and the target coolant temperature increases, an output of the radiation pump may be increased. The output may include a pump speed, a pump flow rate, and/or a pump pressure. The controller may use the measured difference as an input to a look-up table, model, or algorithm which may generate the pump setting as an output. For example, the output of the radiation pump may increase monotonically as radiator heat loss efficiency decreases. By operating the radiator pump as a function of the required additional cooling, electrical power consumption of the overall cooling system is reduced.

Thus, the radiator pump is the primary actuator that is controlled to achieve the target CHT. A power level of the radiator pump is modulated to pull the cool radiator water into the engine. As such, radiator pump control may be based on a priori knowledge of the water temperature entering the engine, such as via an upstream radiator inlet temperature sensor. The engine controller then adjusts the radiator pump to control on coolant thermal power (which is flow rate*delta T) and not simply flow rate.

For illustration, the proportional gain is in terms of kW of cooling per ° C. above CHT target. The cooling power is the product of flow rate and delta T.

Cooling power may be determined by the equation:

$$\text{Cooling power} = \text{volume flow rate} * \text{density} * \text{specific heat} * \text{delta T}$$

where delta T=CHT−Radiator temperature.

The target CHT is determined as a function of engine power. At light power, the target CHT may be, for example, 105° C. At maximum power, the target CHT may be, for example, 85° C. This enables the engine controller to control CHT to incipient knock. Lowering CHT at high engine power may limit or avoid having to use fuel penalizing actions such as rich air-fuel ratio operation or spark retard.

Having cooler water available at the engine water inlet significantly eliminates delay and allows for much more dynamic control of CHT. Further, sensing the engine-in temperature and selecting the flow rate further limits cycling of CHT.

At 312, while operating the radiator pump and while the thermostat valve is open and the engine temperature is near (but not at) the target coolant temperature, the method includes adjusting a radiator cooling fan speed and a grille shutter opening to assist in heat loss to ambient air across the radiator. For example, the radiator cooling fan speed and grille shutter opening may be adjusted as a function of a measured temperature difference across the radiator, the measured temperature difference reflective of the radiator's efficiency. In one example, the temperature difference across the radiator is measured based on outputs of the radiator inlet and outlet temperature sensors. As the temperature difference decreases, the radiator efficiency is inferred to drop. Accordingly, as the temperature difference decreases, the radiator cooling fan speed may be increased while grille shutter opening may be increased (while taking into account drag limitations). The controller may use the measured temperature difference as an input to a look-up table, model, or algorithm which may generate the fan and grille shutter setting as an output.

It will be appreciated that the radiator fan is controlled to achieve a target temperature below the target CHT (or below the target ECT). For example, the radiator fan may be controller to achieve a target temperature that is 10 or 15° C. below the target CHT. The fan is not cycled at high power. Instead its control is continuous. Operation at spurts of high fan power is more power consumptive than operating at lower, continuous power levels. Thus, by limiting fan cycling between high and low settings, overall power consumption at the radiator fan is reduced.

The grille shutters are controlled to provide the same objective as the radiator fan. A grille shutter setting that provides the lowest power consumption is selected. The power consumption of having the grille shutters open depends on the square of vehicle speed. Thus, the controller may use a portion of each to find the lowest power radiator cooling air flow.

It will be appreciated that the radiator fan and grilles shutters may be run at higher power levels to accommodate other heat exchangers, such as other heat exchangers placed in series with the engine radiator.

In this way, the controller may not run the circulation pump until the coolant is hot enough to allow local boiling. The controller may then run that radiator pump just enough to limit engine outlet temperature. Further, the controller may run the radiator fan (or grille shutters) just enough to provide the minimum radiator temperature drop. By coordinating these adjustments, sufficient engine cooling can be provided while reducing power losses and improving engine fuel economy. By coordinating the pump control with the fan and grille shutter control, the radiator output temperature can be targeted to be 10 or 20° C. below engine temperature. This allows the engine to have a source of hot and cold coolant with which to control the engine water temperature. By varying the power provided to the radiator pump and adjusting the thermostat position, CHT may be better controlled, reducing the occurrence of hot spots. For example, by closing the thermostat if CHT is 5° below target, unnecessary radiator flow. Otherwise, when the thermostat valve is open, radiator pump power can be varied to achieve a target temperature. In this case, the thermostat is actually used as a device to enforce zero flow since it cuts off the natural convection. The pumps also provide for variable engine temperature control with low temperature for high power and higher temperature for lower engine power. The system also reduces pumping against a closed valve, and associated power losses. In addition, the approach reduces blowing on a radiator with a closed thermostat valve. By closing the thermostat valve (herein also referred to as a radiator isolation valve), a faster temperature increase is enabled. In addition, by providing full power to the radiator pump which is now pumping pre-cooled water, a faster temperature decrease can be enabled. In other words, when the thermostat valve is closed, the radiator loop acts a source of cooled water that can be used by the radiator pump, when the thermostat valve is opened, to rapidly cool engine temperature.

It will be appreciated that in steady state, the lowest power solution is to let the radiator be at engine temperature because it means the least fan power. However, this eliminates the ability to lower engine temperature for power increases. By keeping the radiator cooler than engine temperature, a net gain is provided since the controller is now able to pull down the engine temperature rapidly and thus lessen the need for spark retard and rich operation (for knock avoidance).

A lower-than-engine radiator temperature allows one to quickly control engine temperature. It removes a huge delay from the temperature control system. Reducing delay can reduce limit cycles. One factor that contributes to limit cycles is cold water entering the engine and not knowing it until it leaves the engine (because that is where the temperature sensor is typically located). This uncertainty is addressed in the current system by including at least two sensors: one at the engine out (radiator in) location, and one in the engine in (and radiator out) location.

Figure 4:
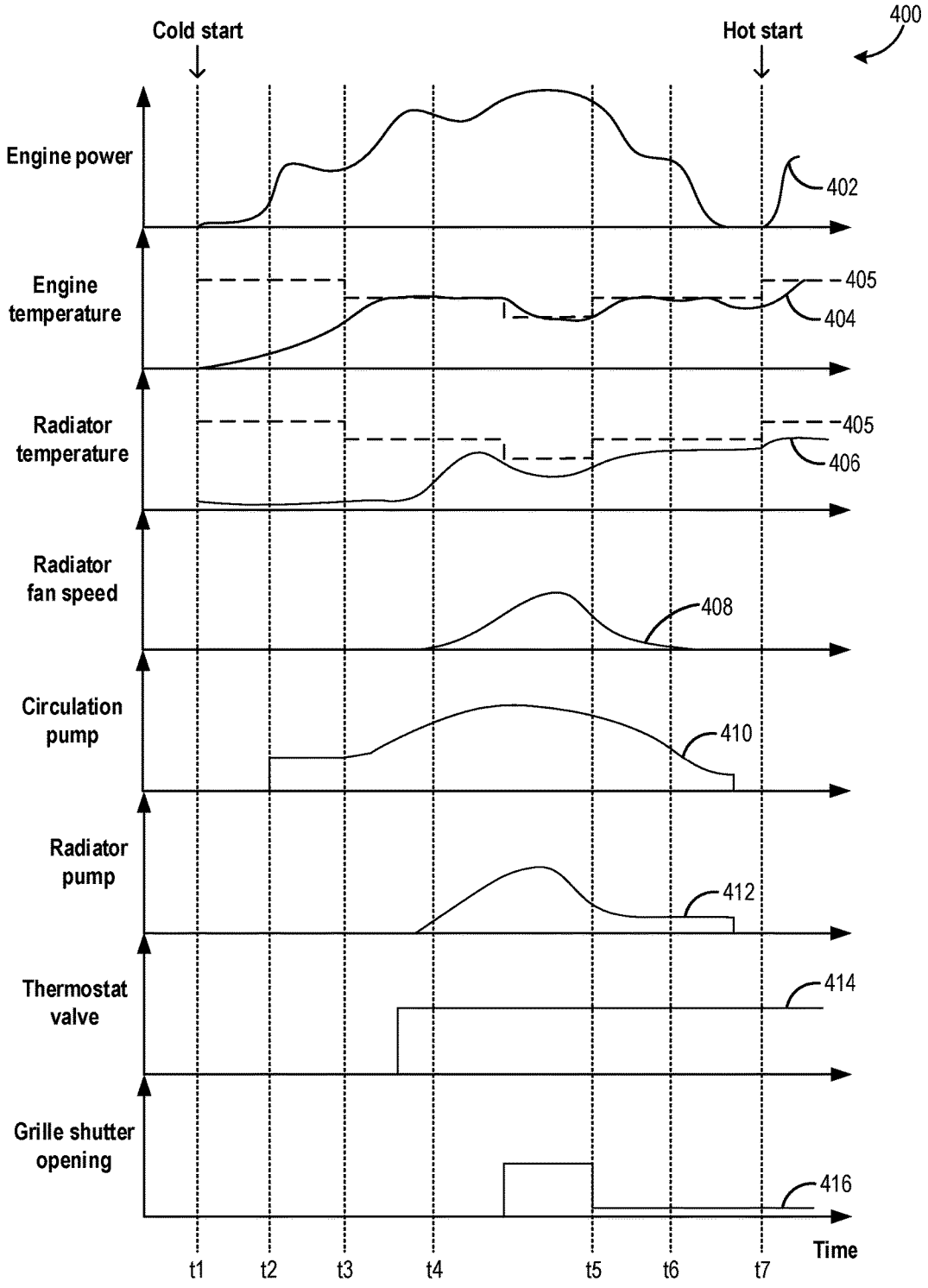
FIG. 4 shows a prophetic example of cooling system operation.

Turning now to FIG. 4, a prophetic example of cooling system operation is shown. The example of FIG. 4 may use the various actuators and sensors of FIGS. 1-2 and the method of FIG. 3. The method enables engine cooling to be provided with reduced power consumption. Map 400 depicts engine power at plot 402. Engine temperature is shown at plot 404 relative to a varying target engine temperature shown at plot 405 (dashed line). Radiator temperature is shown at plot 406, also relative to the target engine temperature. Radiator fan speed is shown at plot 408. Circulation pump output is shown at plot 410 while radiator pump output is shown at plot 412. Thermostat valve position (open or closed) is shown at plot 414. Grille shutter opening is shown at plot 416. All plots are shown over time along the x-axis.

Prior to t1, the engine is shutdown. At t1, the engine is restarted responsive to operator torque demand. Due to lower ambient temperature and a longer than threshold duration elapsed since the engine was last shutdown, the engine temperature is significantly below the target temperature, and therefore the engine restart at t1 is an engine cold-start.

The engine starts to warms-up after the cold-start, such as due to cylinder fuel combustion, while the engine temperature remains below the target temperature. The circulation pump is not turned on at the engine start but after a delay. Specifically, at t2, soon into the engine warm up, and once the engine temperature has risen above a lower threshold (not shown, such as above 70° C.), the circulation pump is turned on. At this time, the thermostat valve is closed and therefore the radiator pump is not operated. Also, the radiator fan is not operated and the grille shutters are held closed.

Between t2 and t3, as the engine power rises from a low to mid-range, the circulation pump output is maintained. After t3, responsive to a further rise in engine power, a consequent lowering of the target engine temperature, it is determined that further engine cooling is required, and therefore the circulation pump output is monotonically increased.

Between t3 and t4, when the sensed engine temperature is just below the target temperature, the thermostat valve is opened. However, the radiator pump is not yet operated as the engine cooling requirement is already sufficiently met.

After t4 responsive to a further rise in engine power, the target engine temperature is lowered further, and the circulation pump output is further increased to meet the increased cooling demand. In addition, the due to the thermostat valve being open, the radiator pump is turned on to further control the engine temperature to the target temperature. Thus between t4 and t5, operation of the circulation pump and the radiator pump is coordinated to control the engine temperature to the target temperature.

Also at t4, the radiator temperature starts to rise due to the increase in engine power. To control a temperature drop across the radiator, and further to maintain the radiator temperature below the target engine temperature, the radiator fan is turned on, and radiator fan speed is adjusted as a function of the cooling required at the radiator. It will be appreciated that the radiator fan is turned on after the radiator pump has been enabled. Additionally, the grille shutter opening is increased to control the temperature drop across the radiator. Opening the grille shutter reducing the fan power needed to provide the required radiator cooling.

At t5, there is decrease in engine power, resulting in a rise in the target engine temperature and relative reduction in the engine cooling demand. Accordingly, the output of the radiator pump and circulation pump is decreased. Since the difference between the radiator temperature and the target engine temperature is now lower, the radiator fan speed is reduced. In addition, the grille shutter opening is reduced.

At t6, responsive to an engine idle-stop condition being met, the engine is shutdown. Responsive to the engine shutdown, the circulation pump is also disabled, however with a delay relative to the engine shutdown. The radiator pump is also disabled since no further engine cooling is required. The grille shutter opening is maintained at the lower level so that additional cooling can be provided at the radiator. Consequently, when the engine is restarted, cooling can be rapidly provided by enabling the radiator pump.

At t7, the engine is restarted. However, due to the engine being restarted shortly after the last shutdown event, the engine start is a hot start. Pump operation is resumed based on engine cooling requirements.

The above approaches provide various advantages. In particular, the use of coordinated control of engine temperature via a circulation pump and a radiator pump, and further via coordinated radiator fan and grille shutter operation, an engine control system may not spend any more power (e.g., electrical power via pumps and fans or aerodynamic power, drag) than is necessary to accomplish the cooling goals. By separating the jobs of engine circulation via a circulation pump, radiator circulation via a radiator pump, and radiator cooling via a radiator fan and grille shutters, the power expended in an engine cooling system to achieve the warm-up/cooling objectives can be minimized. In this way, engine cooling is provided in a more fuel economical manner by decreasing the electrical power consumption of the various engine cooling system components. The technical effect of separating engine cooling functions between a circulation pump and a radiator pump is that heat transfer at the cylinder head can be optimized while also optimizing heat loss at the radiator. By using the circulation pump to effect a target temperature difference at the engine block, cylinder head hot spot occurrence is reduced. By using the radiator pump to regulate the coolant temperature to a target temperature, heat loss at the radiator may be provided more efficiently. By operating the radiator pump only when the thermostat valve is open, electrical power losses incurred due to pumping against a closed valve are reduced. By adjusting the setting of vehicle grille shutters and a radiator fan when the radiator pump is operating, heat lost at the radiator is increased while reducing cycling of the fan and grille shutters. By reducing power losses across the engine cooling system while using an additional pump (relative to conventional systems), the efficiency of the engine cooling system is improved, improving overall engine fuel economy.

One example engine coolant system, comprises: a first pump coupled between a thermostat and a cylinder head; a second pump coupled between the thermostat and a radiator fan; grille shutters; a first temperature sensor for sensing coolant temperature at a radiator outlet; and a second temperature sensor for sensing the coolant temperature at a radiator inlet. In the preceding example, additionally or optionally, the system further comprises a controller including computer-readable instructions stored on non-transitory memory for: adjusting an output of the first pump based on engine power, the first pump operated independent of a state of the thermostat; and selectively operating the second pump responsive to the thermostat being open. In any or all of the preceding examples, additionally or optionally, the system further comprises an engine coolant temperature (ECT) sensor and a cylinder head temperature (CHT) sensor, and wherein adjusting the output of the first pump based on engine power includes adjusting the output of the first pump as a difference between sensed engine temperature and target engine temperature increases, the sensed engine temperature including sensed ECT or sensed CHT. In any or all of the preceding examples, additionally or optionally, the controller includes further instructions for adjusting the target engine temperature as a function of each of intake air temperature, engine power, and feedback knock from a knock sensor. In any or all of the preceding examples, additionally or optionally, the target engine temperature is lowered as the intake air temperature decreases, the engine power increases, or the feedback knock increases. In any or all of the preceding examples, additionally or optionally, the output of the first pump is increased monotonically as the difference between the sensed engine temperature and the target engine temperature increases. In any or all of the preceding examples, additionally or optionally, adjusting the output of the first pump includes adjusting one or more of pump speed, pump flow rate, and pump output pressure. In any or all of the preceding examples, additionally or optionally, adjusting the output of the first pump based on engine power includes increasing the output of the first pump until sensed engine temperature is at the target engine temperature. In any or all of the preceding examples, additionally or optionally, selectively operating the second pump responsive to the thermostat being open includes when the thermostat is open, adjusting an output of the second pump as a function of a difference between sensed radiator inlet temperature (RIT) and sensed radiator outlet temperature (ROT). In any or all of the preceding examples, additionally or optionally, the output of the second pump is increased as the difference between sensed RIT and sensed ROT decreases. In any or all of the preceding examples, additionally or optionally, an opening temperature of the thermostat is set to be lower than the target coolant temperature. In any or all of the preceding examples, additionally or optionally, the controller includes further instructions for: while operating the second pump, adjusting a speed of the radiator fan and a degree of opening of the grill shutters to maintain a threshold difference between temperature at the radiator inlet and the radiator outlet.

An example method comprises: circulating coolant through a cylinder head via a first pump, independent of a state of a thermostat valve, as a function of engine temperature; and circulating coolant through the cylinder head via a second pump, based on the state of the thermostat valve, as a function of the engine temperature. In the preceding example, additionally or optionally, the first pump is coupled in an engine coolant line between the thermostat and the cylinder head and the second pump is coupled in the engine coolant line between the thermostat and a radiator fan. In any or all of the preceding examples, additionally or optionally, the circulating via the first pump includes increasing an output of the first pump monotonically as the engine temperature exceeds a target temperature, the target temperature selected as a function of intake air temperature, feedback knock, and engine load. In any or all of the preceding examples, additionally or optionally, the method further comprises opening the thermostat responsive to the engine temperature being within a threshold of the target temperature, and wherein the circulating via the second pump includes enabling the pump responsive to the thermostat being open, and adjusting an output of the second pump as the engine temperature exceeds the target temperature. In any or all of the preceding examples, additionally or optionally, the method further comprises, while the thermostat is open, adjusting each of a radiator fan speed and a grille shutter opening responsive to a sensed radiator inlet temperature and a sensed radiator inlet temperature to maintain a larger than threshold temperature difference across the radiator.

Another example method for an engine, comprises: while a thermostat of a coolant line is closed, maintaining engine temperature at or below a target temperature via a first coolant pump; and while the thermostat is open, maintaining the engine temperature below the target temperature via each of the first coolant pump and a second coolant pump, the second pump coupled upstream of the first pump in the coolant line. In the preceding example, additionally or optionally, the method further comprises, while the thermostat is open, adjusting each of a radiator fan speed and a grille shutter opening to maintain a threshold difference between a sensed radiator inlet temperature and a sensed radiator outlet temperature. In any or all of the preceding examples, additionally or optionally, the method further comprises, opening the thermostat valve responsive to the engine temperature being within a threshold of the target temperature, the target temperature selected as a function of intake air temperature, feedback knock, and engine load, the target temperature lowered as the intake air temperature decreases, feedback knock increases, or engine load increases.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine coolant system, comprising:

a first pump coupled between a thermostat and a cylinder head;

a second pump coupled between the thermostat and a radiator fan;

grille shutters;

a first temperature sensor for sensing coolant temperature at a radiator outlet; and a second temperature sensor for sensing the coolant temperature at a radiator inlet.

2. The system of claim 1, further comprising a controller including computer-readable instructions stored on non-transitory memory for:

adjusting an output of the first pump based on engine power, the first pump operated independent of a state of the thermostat; and selectively operating the second pump responsive to the thermostat being open.

3. The system of claim 2, further comprising an engine coolant temperature (ECT) sensor and a cylinder head temperature (CHT) sensor, and wherein adjusting the output of the first pump based on engine power includes adjusting the output of the first pump as a difference between sensed engine temperature and target engine temperature increases, the sensed engine temperature including sensed ECT or sensed CHT.

4. The system of claim 3, wherein the controller includes further instructions for adjusting the target engine temperature as a function of each of intake air temperature, engine power, and feedback knock from a knock sensor.

5. The system of claim 4, wherein the target engine temperature is lowered as the intake air temperature decreases, the engine power increases, or the feedback knock increases.

6. The system of claim 3, wherein the output of the first pump is increased monotonically as the difference between the sensed engine temperature and the target engine temperature increases.

7. The system of claim 2, wherein adjusting the output of the first pump includes adjusting one or more of pump speed, pump flow rate, and pump output pressure.

8. The system of claim 3, wherein adjusting the output of the first pump based on engine power includes increasing the output of the first pump until sensed engine temperature is at the target engine temperature.

9. The system of claim 1, wherein selectively operating the second pump responsive to the thermostat being open includes when the thermostat is open, adjusting an output of the second pump as a function of a difference between sensed radiator inlet temperature (RIT) and sensed radiator outlet temperature (ROT).

10. The system of claim 9, wherein the output of the second pump is increased as the difference between sensed RIT and sensed ROT decreases.

11. The system of claim 3, wherein an opening temperature of the thermostat is set to be lower than the target engine temperature.

12. The system of claim 1, wherein the controller includes further instructions for:

while operating the second pump, adjusting a speed of the radiator fan and a degree of opening of the grill shutters to maintain a threshold difference between temperature at the radiator inlet and the radiator outlet.

13. A method, comprising:

circulating coolant through a cylinder head via a first pump, independent of a state of a thermostat valve, as a function of engine temperature; and circulating coolant through the cylinder head via a second pump, based on the state of the thermostat valve, as a function of the engine temperature.

14. The method of claim 13, wherein the first pump is coupled in an engine coolant line between the thermostat and the cylinder head and the second pump is coupled in the engine coolant line between the thermostat and a radiator fan.

15. The method of claim 13, wherein the circulating via the first pump includes increasing an output of the first pump monotonically as the engine temperature exceeds a target temperature, the target temperature selected as a function of intake air temperature, feedback knock, and engine load.

16. The method of claim 15, further comprising opening the thermostat responsive to the engine temperature being within a threshold of the target temperature, and wherein the circulating via the second pump includes enabling the pump responsive to the thermostat being open, and adjusting an output of the second pump as the engine temperature exceeds the target temperature.

17. The method of claim 16, further comprising, while the thermostat is open, adjusting each of a radiator fan speed and a grille shutter opening responsive to a sensed radiator inlet temperature and a sensed radiator inlet temperature to maintain a larger than threshold temperature difference across the radiator.

18. A method for an engine, comprising:

while a thermostat of a coolant line is closed, maintaining engine temperature at or below a target temperature via a first coolant pump; and while the thermostat is open, maintaining the engine temperature below the target temperature via each of the first coolant pump and a second coolant pump, the second pump coupled upstream of the first pump in the coolant line.

19. The method of claim 18, further comprising, while the thermostat is open, adjusting each of a radiator fan speed and a grille shutter opening to maintain a threshold difference between a sensed radiator inlet temperature and a sensed radiator outlet temperature.

20. The method of claim 18, further comprising, opening the thermostat valve responsive to the engine temperature being within a threshold of the target temperature, the target temperature selected as a function of intake air temperature, feedback knock, and engine load, the target temperature lowered as the intake air temperature decreases, feedback knock increases, or engine load increases.

* * * * *